United States Patent [19]

Müller

[11] 4,202,232

[45] May 13, 1980

[54] APPARATUS FOR TRIMMING STACKS OF PAPER SHEETS OR THE LIKE

[75] Inventor: Hans Müller, Zofingen, Switzerland

[73] Assignee: Grapha-Holding AG, Hergiswil, Switzerland

[21] Appl. No.: 917,522

[22] Filed: Jun. 21, 1978

[30] Foreign Application Priority Data

Jul. 2, 1977 [CH] Switzerland ..... 8122/77

[51] Int. Cl.[2] ..... B26D 5/08

[52] U.S. Cl. ..... 83/519; 83/618; 83/642; 83/644; 83/925 A

[58] Field of Search ..... 83/519, 513, 618, 644, 83/925 A, 642, 643, 647

[56] References Cited

U.S. PATENT DOCUMENTS 1,267,283 5/1918 Seybold ..... 83/519 X 3,528,332 9/1970 Thumim et al. ..... 83/925 A X

FOREIGN PATENT DOCUMENTS 531272 8/1931 Fed. Rep. of Germany ..... 83/644

*Primary Examiner*—Frank T. Yost

*Attorney, Agent, or Firm*—Peter K. Kontler

[57] ABSTRACT

Apparatus for trimming the front, head and foot ends of brochures has a stationary platform which supports one brochure at a time. A first knife which trims the front end of the brochure on the platform descends in a vertical plane ahead of two additional knives which thereupon simultaneously trim the head and foot ends of the same brochure as soon as the first knife completes the trimming of the front end. The first knife is pivoted forwardly and away from the additional knives while the additional knives move toward and trim the brochure on the platform. This insures that the first knife is held out of the way while the additional knives move to positions in which their forward ends extend beyond the trimmed front end of the brochure.

10 Claims, 4 Drawing Figures

APPARATUS FOR TRIMMING STACKS OF PAPER SHEETS OR THE LIKE

BACKGROUND OF THE INVENTION

The present invention relates to apparatus for cutting stacks of paper sheets or the like, and more particularly to improvements in apparatus for trimming the head, foot and front ends of brochures, pamphlets, books or like accumulations of overlapping sheets. Still more particularly, the invention relates to improvements in apparatus for trimming three different sides of each of a series of successive stacks of sheets by three discrete cutting implements.

An apparatus with three discrete knives for the trimming of head, foot and front ends of brochures or the like is disclosed in Swiss Pat. No. 340,479. The patented apparatus comprises a first severing station where two discrete knives trim the head and foot ends of brochures, and a second severing station at which a third knife trims the front ends of the brochures. An initial cycle of operation involves the trimming of a brochure at the first station and transport of the thus treated brochure to the second station. During the next cycle, the brochure is trimmed by the knife at the second station and is removed from the apparatus. The patented apparatus exhibits the advantage that a substantial part of each cycle is available for transport of brochures so that the apparatus can treat a large number of brochures per unit of time. However, the patented apparatus also exhibits a serious drawback, namely, that each brochure must be properly centered at two different stations, i.e., at the first station preparatory to trimming by the knives which remove material at the head and foot ends, and thereupon at the second station preparatory to removal of material from the front end. Accurate centering presents serious problems, especially when the brochures to be trimmed are transported at a high speed. Therefore, the quality of treatment in the patented apparatus is not entirely satisfactory, especially if the brochures are transported at an elevated speed.

OBJECTS AND SUMMARY OF THE INVENTION

An object of the invention is to provide an apparatus which can accurately trim three ends of each of a series of successive brochures or the like and whose output is at least as high as that of presently known apparatus.

Another object of the invention is to provide an apparatus wherein the front, head and foot ends of successive brochures can be trimmed during dwell of each brochure at a single station.

A further object of the invention is to provide an apparatus of the above outlined character wherein the knives for trimming three different ends of each of a series of successive brochures or the like receive motion from continuously operated drive means.

An additional object of the invention is to provide the apparatus with novel and improved means for synchronizing the movements of that knife which trims the front ends of successive items with the movements of knives which trim the head and foot ends of such items.

Another object of the invention is to provide a simple and compact apparatus which can be installed in existing production lines for brochures, pamphlets, or analogous stacks of overlapping paper sheets or the like.

A further object of the invention is to provide the apparatus with novel and improved means for preventing each knife and/or knife carrier from interfering with movements of the other knives and/or knife carriers.

An ancillary object of the invention is to provide the apparatus with novel and improved means for causing each knife to perform a composite movement during trimming of the respective end of a brochure or the like.

The invention is embodied in an apparatus for trimming the front, head and foot ends of a series of successive stacks of paper sheets or the like (e.g., stacks of sheets which constitute pamphlets, brochures, signatures, books or the like). The apparatus comprises a single trimming station which includes a table or an analogous means for supporting one stack of the series at a time (the table may be horizontal and can be installed in the space between two parallel upright side walls of a frame), a first knife for trimming the front end of the stack on the support, two additional knives for simultaneously trimming the head and foot ends of the stack on the supporting means, and means for cyclically operating the knives (during each cycle, the knives trim a different stack of the aforementioned series). The operating means includes means for moving the first knife into trimming engagement with the front end of the stack on the supporting means during a first portion of a cycle and means for simultaneously moving the additional knives into trimming engagement with the head and foot ends of the same stack on the supporting means during a subsequent portion of the same cycle (such subsequent portion may but need not immediately follow the first portion of the respective cycle).

The first mentioned moving means (for the first knife) preferably comprises a holder (e.g., a horizontal shaft) for the first knife and the first knife is movable with respect to such holder in directions toward and away from the additional knives. The apparatus then further comprises means for moving the first knife away from the additional knives upon completion of trimming of the front end of the stack on the supporting means so that the first knife is spaced apart from the additional knives during movement of the additional knives toward and during trimming engagement of additional knives with the stack on the supporting means. This insures that the first knife is out of the way and the additional knives can extend beyond the freshly trimmed front end of the stack on the supporting means during trimming of the head and foot ends of the same stack. The first knife is preferably pivotable toward and away from the additional knives.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
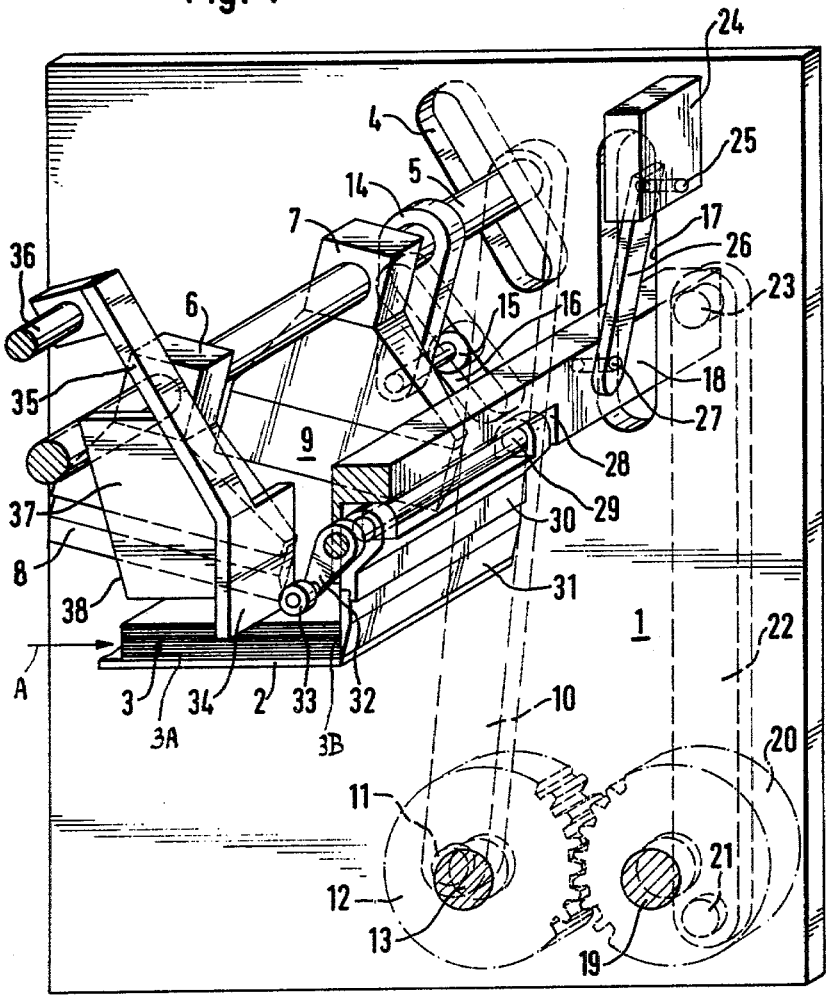
FIG. 1 is a perspective view of the improved apparatus, with certain parts omitted with certain parts shown in section.

The apparatus of FIG. 1 comprises a frame including two side walls one of which is shown at 1. The severing station is located between the two side walls and includes a supporting means here shown as a table 2 to which successive stacks 3 of paper sheets (e.g., brochures or the like) of a series of stacks are transported in the direction indicated by arrow A. The transporting mechanism for stacks 3 forms no part of the invention; it suffices to say that such mechanism delivers the stacks seriatim onto the table 2 and that another known mechanism thereupon centers each of a series of successive stacks in the position as shown in FIG. 1 so that the head end is adjacent to the illustrated side wall 1, that the foot end 3A is adjacent to the non-illustrated side wall, and that the front end 3B is located to the right of the head and foot ends.

The side walls 1 are formed with forwardly and downwardly inclined elongated guide slots 4 (refernce being had to the direction indicated by the arrow A). These slots receive and guide the respective end portions of a shaft 5 which is movable sideways and is also rotatable about its axis. The shaft 5 is rigidly connected with two knife carriers 6 and 7 for (additional) knives 8 and 9. The knives 8 and 9 are disposed in two parallel planes and respectively trim the head and foot ends of the stack 3 on the table 2. These knives are separably connected to the respective carriers 6 and 7, e.g., by means of bolts and nuts, screws or other suitable fasteners.

The end portions of the shaft 5 extend outwardly beyond the respective guide slots 4 and are connected with links 10 (one shown behind the wall 1). The lower end portion of the illustrated link 10 is connected to an eccentric pin 11 of a gear 12 which is keyed to and is continuously driven by a shaft 13. The shaft 13 receives torque from a suitable prime mover, not shown. This shaft is journalled in both side walls of the frame and carries a second gear, corresponding to the gear 12, which transmits motion to a second link (corresponding to the link 10) located in front of the non-illustrated side wall. As the shaft 13 rotates, the gears 12, their eccentric pins 11 and the two links 10 cause the shaft 5 to move back and forth along an elongated path which is defined by the guide slots 4. This results in movements of the knives 8 and 9 downwardly and forwardly toward and rearwardly and upwardly away from the table 2.

A lever 14 which is secured to the shaft 5 is provided with a roller follower 15 which extends into a guide slot 16 of the side wall 1. The inclination of the path which is defined by the slot 16 with respect to the path which is defined by the illustrated slot 4 is selected in such a way that sidewise movement of the shaft 5 along the guide slots 4 entails a certain angular movement of the shaft 5 (and hence of the knives 8 and 9). In other words, the parts 14–16 can change the orientation of knives 8, 9 in their respective vertical planes. This is desirable because it insures that the cutting edges of the knives 8 and 9 begin to trim the respective ends of the stack 3 at the front end 3B and thereupon gradually move to substantially horizontal positions (see FIGS. 2 and 3).

The side walls 1 are further provided with vertical guide slots 17 (only one shown in FIG. 1) defining vertical paths for the end portions of a crosshead 18 for a carrier 30 of a (first) knife 31 serving to trim the front end 3B of a stack 3 on the table 2. The crosshead 18 is movable up and down as well as lengthwise, i.e., at right angles to the planes of the side walls 1. The means for moving the crosshead 18 up and down comprises a shaft 19 which is adjacent to the shaft 13 and is journalled in the side walls 1, two gears 20 (one shown) which are keyed to the shaft 19 and mesh with the adjacent gears 12, two links 22 (one shown) each of which is articulately connected to the respective gear 20 by an eccentrically mounted universal joint 21, and two additional universal joints 23 which articulately connect the upper end portions of the links 22 to the respective ends of the crosshead 18 (at the outer sides of the corresponding side walls 1). The gears 12, 20 couple the moving means for the knife 18 with the moving means for the knives 8, 9.

The means for causing the crosshead 18 to reciprocate in substantial parallelism with the shafts 5, 13 and 19 is mounted on a bracket 24 which is secured to the illustrated side wall 1. The bracket 24 supports a stub shaft 25 for a link 26 which is coupled to the adjacent portion of the crosshead 18 by a pin 27. The link 26 automatically compels the crosshead 18 to move lengthwise while the crosshead 18 moves up or down under the action of the links 22. The purpose of back-and-forth (lengthwise) movements of the crosshead 18 is to facilitate the penetration of the knife 31 into the front end 3B of the stack 3 on the table 2.

The central portion of the crosshead 18 has a cutout 28 for a horizontal holder here shown as a shaft 29 whose end portions are mounted in the crosshead 18 and which supports the aforementioned carrier 30 for the knife 31. The means for separably connecting the knife 31 to the carrier 30 is not shown in the drawing. The holder 29 further supports a lever 32 whose free end portion carries a roller follower 33. When the lever 32 is pivoted, the holder 29 pivots the carrier 30 and the knife 31 about a horizontal axis which is parallel to the axis of the shaft 5. The follower 33 tracks a plate-like cam 34 which causes the knife 31 to move between a position which is shown in FIG. 1 and in which the knife 31 is located in a vertical plane, an intermediate position in which the knife 31 is inclined forwardly and downwardly (see FIG. 2) and an end position (shown in FIG. 3) in which the inclination of the knife 31 is more pronounced. Such pivotal movements of the knife 31 about the axis of the holder 29 are necessary in order to insure that the knife 31 (which trims the front end 3B prior to trimming of the head and foot ends) does not interfere with movements of the knives 8 and 9 to the positions shown in FIGS. 2 and 3.

The plate cam 34 is secured to a lever 35 which is freely pivotable on a stub shaft 36 secured to the front side wall of the frame. The lever 35 further supports a second plate 37 having an edge face 38 which abuts against the peripheral surface of the shaft 5. As the shaft 5 moves downwardly, it causes the plate 37 to pivot the lever 35 which causes the cam 34 to pivot the lever 32 and hence the knife 31 about the axis of the holder 29. In the illustrated embodiment, the edge face 38 is held in continuous contact with the shaft 5 due to gravity of the parts which are pivotable about the axis of the stub shaft 36 and about the axis of the holder 29; however, it is equally possible to provide means for biasing the plate 37 against the shaft 5. The cam 34 can move away from the roller follower 33 when the knife 31 is located in a vertical plane.

Figure 2:
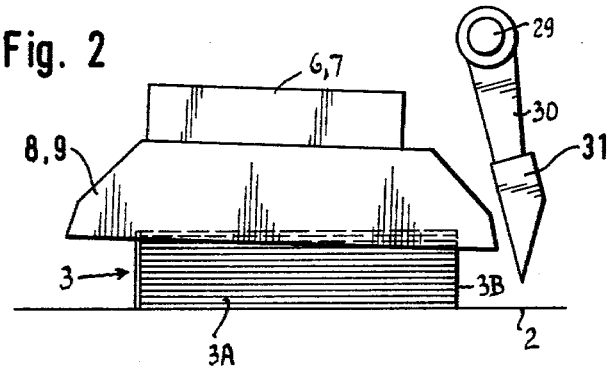
FIG. 2 is a schematic side elevational view of the severing station, showing the knives in positions they assume during trimming of the head and foot ends of a stack.
Figure 4:
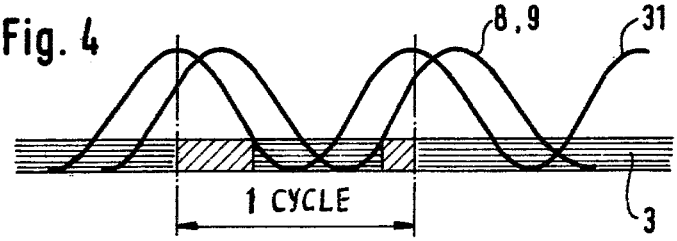
FIG. 4 is a diagram showing the movements of the cutting edges of knives during successive cycles.

FIG. 4 shows the manner in which the means for moving the knives 8, 9 and 31 are synchronized so that the cutting edge of the knife 31 trims the front end of a stack 3 on the table 2 before the knives 8 and 9 begin to trim the respective ends of the same stack. While moving downwardly, the knife 31 is held in a vertical plane (i.e., in a plane which is normal to the plane of the table 2) and remains in such vertical plane during that portion of a cycle which is required for trimming of the front end 3B. The knives 8, 9 begin to move forwardly and downwardly with a slight delay which is so selected that, the cutting edges of the knives 8, 9 reach the foremost portions of the respective ends of the stack 3 on the table 2 during the same cycle but after the severing operation of the front end 3B by the knife 31 is completed. The cam 34 engages the follower 33 after the completion of the front-severing operation and causes the knife 31 to pivot toward the position of FIG. 2. This provides room for unimpeded movement of the knives 8, 9 into engagement with the respective ends of the stack 3. As shown in FIG. 2, the foremost portions of the knives 8 and 9 of the illustrated apparatus extend forwardly beyond the front end 3B so that it is necessary to pivot the knife 31 out of the way.

The height of the cam 34 is selected in such a way that the upper edge face of the cam 34 moves to a level below the follower 33 only after the knife 31 begun to move upwardly and reached a level above the knife carriers 6, 7; the knife 31 is then free to pivot back into a vertical plane without colliding with the carriers 6 and 7.

FIG. 4 further shows that approximately one-half of each cycle is available for transport of a stack 3 to and from the table 2, and that the other half corresponds to the interval of dwell of the stack 3 on the table 2, i.e., to the interval during which the stack 3 is trimmed, first by the knife 31 and thereupon by the knives 8 and 9. Consequently, the apparatus can trim a large number of stacks per unit of time.

Figure 3:
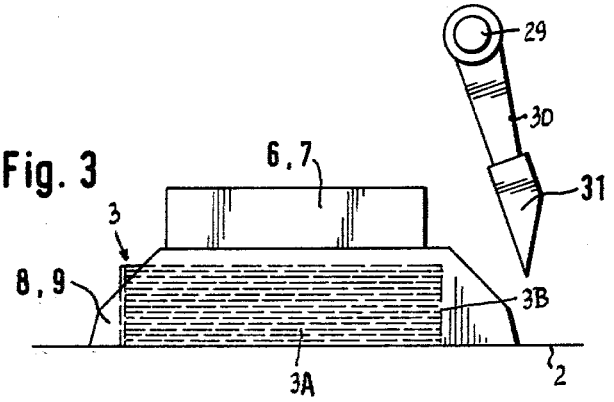
FIG. 3 is a similar schematic side elevational view of the severing station, showing the knives in positions they assume upon completion of the trimming of head and foot ends of the stack.

FIGS. 2 and 3 show that the knife 31 need not be remote from the knives 8, 9 during that portion of the cycle which follows the trimming of the front end 3B and ends on completion of trimming of the head and foot ends. The knife 31 is raised to a position above that which is shown in FIG. 3 before it is allowed to return into a vertical plane. Thereafter, the knives 8, 9 and their carriers 6, 7 are retracted upwardly and rearwardly so that the parts 6–9 cannot interfere with downward movement of the knife 31 into engagement with the front end 3B of the next stack 3 on the table 2.

An important advantage of the improved apparatus is that each stack 3 is arrested and centered only once, namely, on the table 2. This eliminates the possibility of inaccurate trimming because the position of the stack 3 on the table 2 remains unchanged during the entire interval which is required to complete the trimming of the front end 3B and to thereupon simultaneously complete the trimming of the head and foot ends.

Another important advantage of the apparatus is that the moving means for the knives 8, 9, 31 need not be operated in stepwise fashion, i.e., the shafts 13 and 19 rotate continuously. All movements are derived from members which receive motion from the shaft 13. It is clear that the prime mover can be coupled with the shaft 19; the gears 20 then drive the adjacent gears 12.

The provision of pairs of links 10 and 22 insures that the shaft 5 and/or the crosshead 18 is not subjected to torsional stresses which could affect the accuracy of the trimming operation.

A conveyor system which can be utilized to deliver stacks 3 onto the table 2 and to remove trimmed stacks from the table is disclosed, for example, in U.S. Pat. No. 2,874,775.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the claims.

I claim:

1. Apparatus for trimming the front, head and foot ends of a series of successive stacks of paper sheets or the like, comprising a single trimming station including means for supporting one stack of said series at a time; a first knife for trimming the front end of the stack on said supporting means; two additional knives for simultaneously trimming the head and foot ends of the stack on said supporting means; and means for cyclically operating said knives, including first means for moving said first knife into trimming engagement with the front end of the stack on said supporting means during a first portion of a cycle and second means for simultaneously moving said additional knives into trimming engagement with the respective ends of the same stack on said supporting means during a subsequent portion of the same cycle, including a holder for said first knife, said first knife being movable with respect to said holder in directions toward and away from said additional knives, said operating means further including third means for moving said first knife away from said additional knives upon completion of trimming of the front end of the stack on said supporting means so that said first knife is spaced apart from said additional knives during movement of said additional knives toward and during trimming engagement of said additional knives with the stack on said supporting means, said cyclically operating means including means for so operating said first second and third moving means that said additional knives contact the stack simultaneously with completion of the trimming of the front end of the stack by said first knife.

2. Apparatus for trimming the front, head and foot ends of a series of successive stacks of paper sheets or the like, comprising a single trimming station including means for supporting one stack of said series at a time; a first knife for trimming the front end of the stack on said supporting means; two additional knives for simultaneously trimming the head and foot ends of the stack on said supporting means; and means for cyclically operating said knives, including first means for moving said first knife into trimming engagement with the front end of the stack on said supporting means during a first portion of a cycle and second means for simultaneously moving said additional knives into trimming engagement with the respective ends of the same stack on said supporting means during a subsequent portion of the same cycle, including a holder for said first knife, said first knife being movable with respect to said holder in directions toward and away from said additional knives, said operating means further including third means for moving said first knife away from said additional knives upon completion of trimming of the front end of the stack on said supporting means so that said first knife is spaced apart from said additional knives during movement of said additional knives toward and during trimming engagement of said additional knives with the stack on said supporting means, including a mobile cam and follower means operatively connected with said first knife, said second means including means for moving said cam.

3. Apparatus as defined in claim 2, wherein said holder defines a pivot axis for said first knife.

4. Apparatus as defined in claim 2, wherein said first moving means comprises means for moving said first knife back and forth in a predetermined plane driving said first portion of each cycle.

5. Apparatus as defined in claim 2, wherein said supporting means is substantially horizontal and said first moving means includes means for moving said first knife substantially vertically up and down, said first knife moving downwardly during said first portion of each cycle.

6. Apparatus as defined in claim 2, wherein said second moving means includes means for moving said additional knives in two parallel planes and for changing the orientation of said additional knives in the respective planes during said subsequent portion of each cycle.

7. Apparatus as defined in claim 2, further comprising means for coupling said first and second moving means.

8. Apparatus as defined in claim 2, wherein said second moving means comprises a shaft rigid with said additional knives, means for moving said shaft sideways along a predetermined path, and means for rotating said shaft during said subsequent portion of each cycle.

9. Apparatus as defined in claim 8, wherein said first moving means comprises a crosshead parallel to said shaft, means for securing said first knife to said crosshead, and means for moving said crosshead sideways along a second path which is inclined with respect to said predetermined path.

10. Apparatus as defined in claim 8, wherein said means for rotating said shaft comprises a lever rigid with said shaft, a follower on said lever and means for defining for said follower a second path which is inclined with respect to said predetermined path.

* * * * *